United States Patent [19]

Vermesse

[11] Patent Number: 4,914,606

[45] Date of Patent: Apr. 3, 1990

[54] ELECTRONIC FRANKING MACHINE INCLUDING A LARGE NUMBER OF AUXILIARY METERS

[75] Inventor: Bernard Vermesse, L'Hay les Roses, France

[73] Assignee: Societe Anonyme dite : SMH Alcatel, Paris, France

[21] Appl. No.: 176,521

[22] Filed: Apr. 1, 1988

[30] Foreign Application Priority Data

Apr. 1, 1987 [FR] France ..... 87 04577

[51] Int. Cl.[4] ..... G07B 17/00

[52] U.S. Cl. ..... 364/518; 364/464.02

[58] Field of Search ..... 364/464.02, 464.03, 364/466, 900, 518

[56] References Cited

U.S. PATENT DOCUMENTS

| | | | |
|---|---|---|---|
| 4,093,999 | 6/1978 | Fuller et al. | 364/900 |
| 4,180,856 | 12/1979 | Check, Jr. et al. | 364/464.03 |
| 4,271,481 | 6/1981 | Check, Jr. et al. | 364/900 |
| 4,306,299 | 12/1981 | Check, Jr. et al. | 364/900 |
| 4,319,328 | 3/1982 | Eggert | 364/466 |
| 4,376,981 | 3/1983 | Check, Jr. et al. | 364/464.02 X |
| 4,484,307 | 11/1984 | Quatse et al. | 364/900 |
| 4,511,793 | 4/1985 | Racanelli | 364/466 |
| 4,524,426 | 6/1985 | Eckert et al. | 364/900 |
| 4,577,283 | 3/1986 | Soderberg et al. | 364/466 |
| 4,823,283 | 4/1989 | Diehm et al. | 364/146 X |
| 4,835,700 | 5/1989 | Tanaka et al. | 364/192 X |

FOREIGN PATENT DOCUMENTS

| | | |
|---|---|---|
| 3517087 | 11/1986 | Fed. Rep. of Germany . |
| 947991 | 1/1964 | United Kingdom . |
| 2032224 | 4/1980 | United Kingdom . |

*Primary Examiner*—P. S. Lall
*Assistant Examiner*—Edward R. Cosimano
*Attorney, Agent, or Firm*—Sughrue, Mion, Zinn, Macpeak & Seas

[57] ABSTRACT

A franking machine comprises a plurality of auxiliary meters designated by name and stored in alphabetical order of meter name in a Meter space of a battery backed-up working memory. Each meter comprises a service zone, a name zone, a date zone, a money meter zone, and a piece count meter zone. A meter is found by scanning through meter names. A meter is created by entering a name, and by storing a meter in the Meter space. This takes place by finding the appropriate alphabetical position for the new meter in the Meter space, and then shifting all subsequent meters in said space to make room for the new meter. A meter is closed by shifting all meters following the meter being closed down one place in the Meter space, starting with the meter immediately following the meter to be closed.

21 Claims, 10 Drawing Sheets

ELECTRONIC FRANKING MACHINE INCLUDING A LARGE NUMBER OF AUXILIARY METERS

The invention relates to operating an electronic franking machine including auxiliary meters, and in particular a machine including a large number of auxiliary meters.

BACKGROUND OF THE INVENTION

In general, a franking machine is equipped with a meter which accumulates the total value of franking operations performed since the machine was put into service, together with a few additional meters to enable the user to account for postage expenses better, for example to enable said postage expenses to be spread over a plurality of budgets. Over a given period of time, these additional meters made available to the user serve to accumulate the total number and/or the total value of franking operations performed. In order to take advantage of the additional meters, it is necessary for the user to be able to name, start, stop, clear, and display each meter individually.

This done by means of the keyboard of the franking machine, by fitting the keyboard with additional keys or by authorizing two or three keys of the keyboard to be depressed simultaneously. This technique can only be envisaged when there are very few additional meters, e.g. only two or three. For a larger number of additional meters, it becomes necessary either to use a considerable number of additional keys, or else to generalize the technique of double or triple key-presses; however if that is done it becomes necessary to provide the machine with a code table and the user needs to refer to this table each time a specific additional meter is to be selected.

If it is desired to stop, clear, or individually request each additional meter, additional keys need to be provided and the keyboard becomes difficult to use, inconvenient, confusing for the user, and necessitating a degree of user training.

French patent application No. 87 02 667 filed Feb. 28, 1987 and entitled "Operating system for an electronic franking machine", describes a franking machine equipped with a plurality of auxiliary meters, e.g. about a score of them, together with a keyboard including a menu key in addition to digit keys. Such a machine can be used both for performing normal franking operations and also for performing special operations by means of the menu key, in particular special operations consisting in selecting an auxiliary meter and in starting it, stopping it, or clearing it. Each auxiliary meter is constituted by a pair of meters, i.e. a money meter which provides the total value of franking operations performed during a given period of time, and a piece count meter which provides the total number of envelopes or labels which have been franked during said period of time. Each auxiliary meter is designated by a number which corresponds to the location occupied by said meter in a an auxiliary meter memory space which is set aside, for example in a battery-backed working memory.

The user must therefore remember the meaning of each meter number, or else maintain an identification list in order to be able to identify meters by their numbers.

If there are only a few meters, the user can readily remember the meaning of each meter number, but even for a score of meters the user tends, in general, to make use of a list, and when the number of additional meters becomes larger, e.g. several tens of meters, then a list becomes practically essential.

Consulting such an identification list, and keeping it up to date as various budgets are created or closed gives rise to a loss of time and is often a source of error.

The object of the invention is to remedy these drawbacks and to enable a meter to be selected without it being necessary to refer to an identification list.

SUMMARY OF THE INVENTION

The present invention provides a franking machine comprising a keyboard fitted with ten digit keys, an Enter key, a Cancel key, a star key, a menu key, and two scrolling keys constituted by an up arrow and a down arrow, a display of the alphanumeric type, a calendar/clock, a microprocessor, a program memory, a text memory, a working memory backed up by a battery, and an audible alarm, all interconnected by a bus, said working memory containing, in a "Meter" space, a plurality of auxiliary meters each of which is constituted by bytes of the working memory and each of which includes a money meter and a piece count meter themselves constituted by such bytes, said text memory storing a first set of messages for normal franking operations and a second set of messages for special operations, said program memory containing programs relating to each message in said first and second sets of messages, said second set of messages being accessible via the menu key, pressing said menu key causing a first or beginning-of-menu message to appear which includes numbered options, with each number corresponding to a digit key on the keyboard, one of the options giving access to the auxiliary meters, the franking machine being characterized by the fact that the auxiliary meters are referenced by name and that they are stored one after the other in the Meter space of the working memory and in alphabetical order of their names.

BRIEF DESCRIPTION OF THE DRAWINGS

An embodiment of the invention is described by way of example with reference to the accompanying drawings, in which.

MORE DETAILED DESCRIPTION

Figure 1:
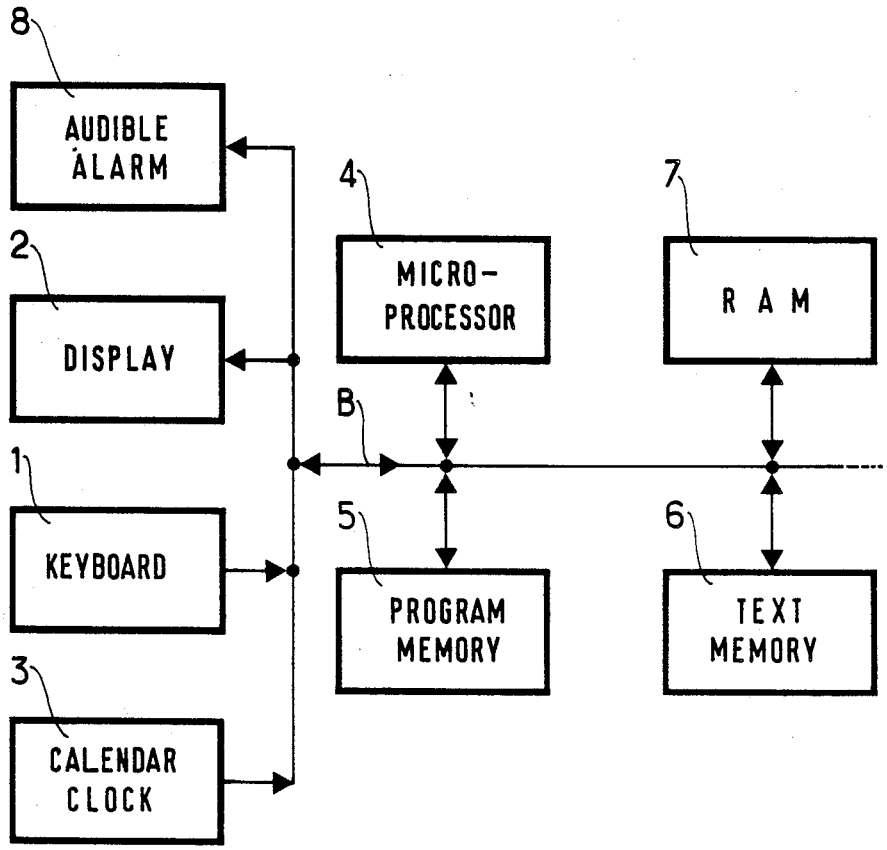
FIG. 1 is a block diagram of a portion of the electronic circuit of an electronic franking machine to which the invention applies.

FIG. 1 is a block diagram of a portion of the electronic circuit of an electronic franking machine to which the invention applies. The franking machine is of the type described in above-mentioned French patent application No. 87 02667. It comprises a keyboard 1, a display 2, a calendar clock 3, a microprocessor 4, a program memory 5, a text memory 6 which is constituted by a read only memory (ROM), a working memory 7 which is constituted by random access memory (RAM), and an audible alarm 8, all interconnected by a bus B. The display is, for example, an alphanumeric display having a display capacity of L lines by N characters each, for example 2 lines by 16 characters. The text memory contains a first set of messages for normal franking operations and a second set of messages for special operations accessible from a menu key M on the keyboard.

Figure 2:
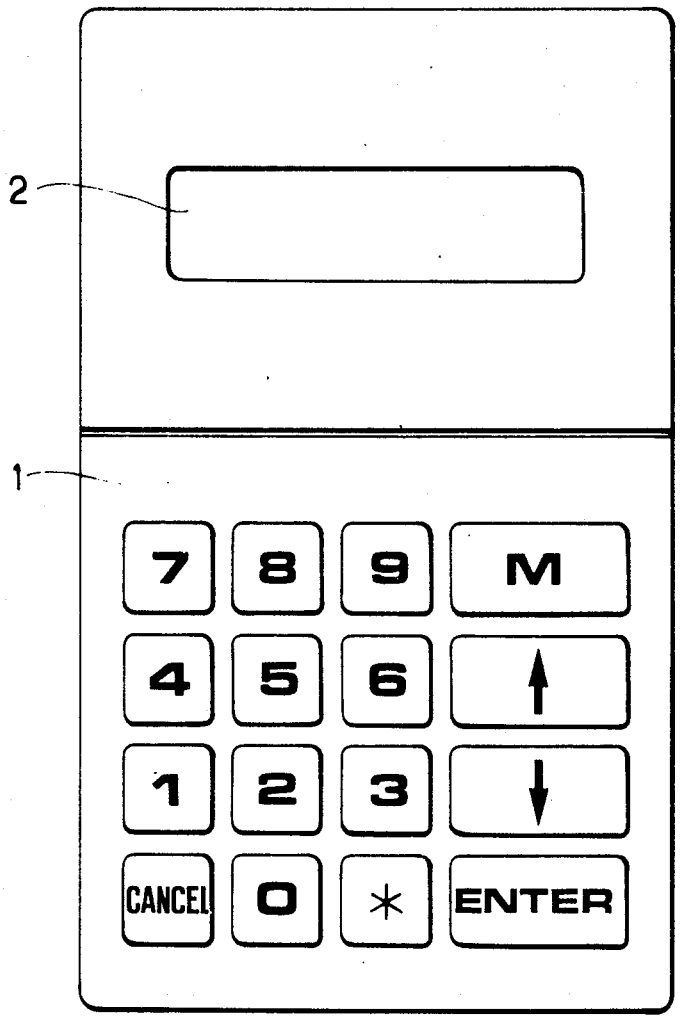
FIG. 2 shows a keyboard and a display for an electronic franking machine.

FIG. 2 shows a keyboard and display assembly fitted to the machine: the keyboard 1 has ten digit keys, a menu key M, a Cancel key CANCEL, a star key *, an Enter key ENTER, and two scrolling keys, one having an up arrow and the other having a down arrow, making 16 keys in all.

In this machine, messages are displayed on the display 2. To do this, the program memory 5 contains as many programs as there are messages, with each program relating to a corresponding message. The messages are split into screens each having L lines by N characters equal to the L lines by N characters that the display can display. An alphanumeric display can be used to display all of the characters that occur in ASCII code, also known as CCITT code No. 5. Each screen of a message is transferred by the program relating to that message from the text memory 6 into a memory space in the working memory 7, said space being referred to as the display image IA and having N×L bytes, with each byte corresponding to one character on one line. The display itself is performed by means of a display program which is a special program contained in the program memory 5 and which is run automatically every 100 milliseconds.

This special program is used to take byte information from the display image IA and transfer it to the display 2 for display purposes.

Figure 3:
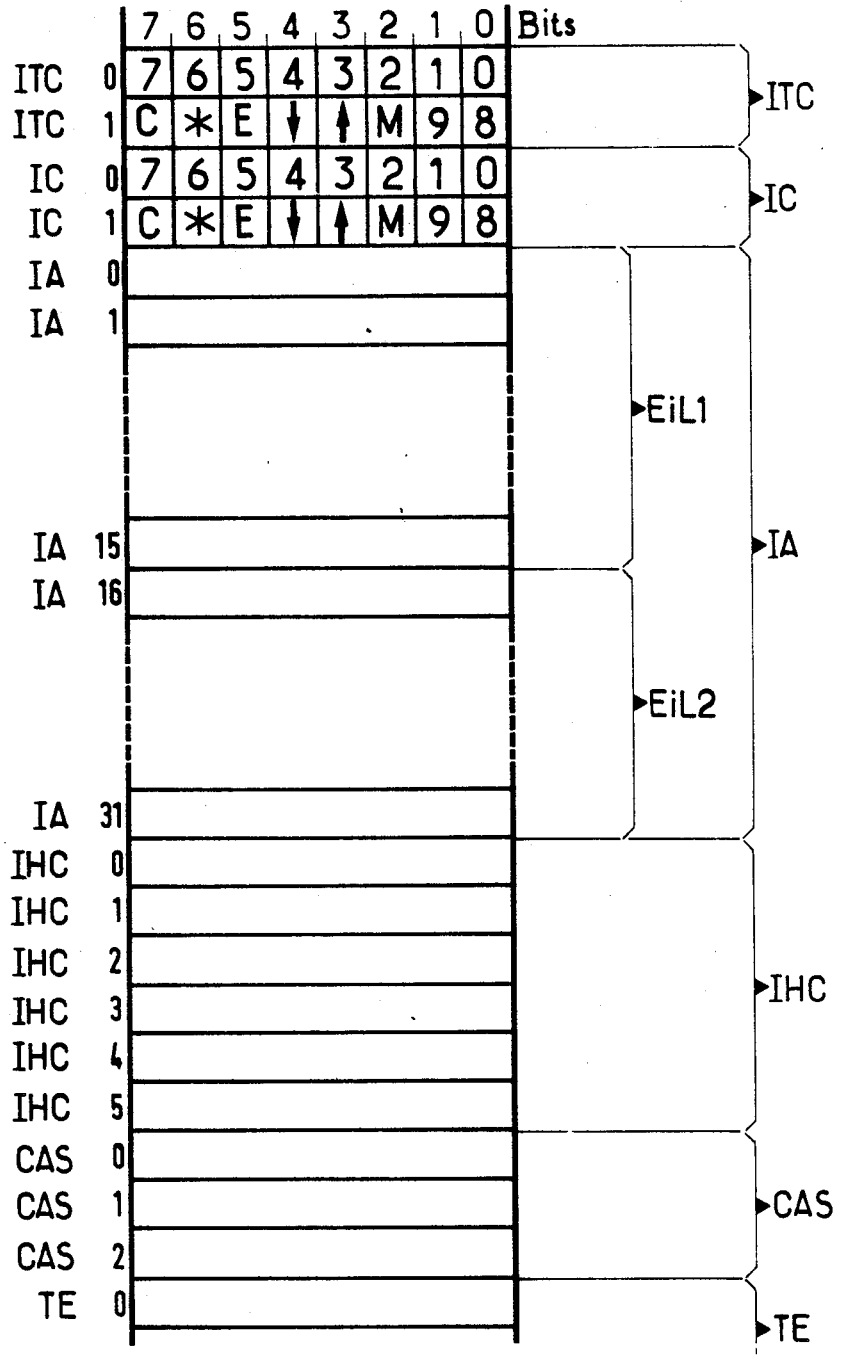
FIG. 3 shows a portion of the contents of the working memory of the FIG. 1 franking machine.

FIG. 3 shows a portion of the contents of the working memory 7, said portion containing:

two bytes ITC0 and ITC1 for a temporary keyboard image ITC; and two bytes IC0 and IC1 for a keyboard image IC.

In these four bytes, the various digits, letters, and symbols are those on the 16 keys of the keyboard, with M designating the menu key, E designating the Enter key, and C designating the Cancel key, and with each key corresponding to one bit in the corresponding bytes.

Said portion further containing: thirty two bytes IA0 to IA31 for the display image IA, with bytes IA0 to IA15 corresponding to the first line EiL1 of a screen Ei, and with bytes IA16 to IA31 corresponding to the second line EiL2 of screen Ei, this being appropriate for a display comprising two lines of 16 characters each;

six bytes IHC0 to IHC5 for a calendar clock image; byte IHC0 is reserved for the year running from 0 to 99, byte IHC1 is reserved for the month running from 1 to 12, byte IHC2 is reserved for the day running from 1 to 31, byte IHC3 is reserved for the hour running from 0 to 23, byte IHC4 is reserved for the minute running from 0 to 59, and byte IHC5 is reserved for the second running from 0 to 59;

three bytes CAS0 to CAS2 for audible alarm control CAS, with byte CAS0 being reserved for the number of beeps to be emitted, byte CAS1 being reserved for the beep emission time, and byte CAS2 being reserved for the inter-beep silence time; and two timing bytes TE0 and TE1, with byte TE0 being reserved for screen timing, i.e. the time for which a screen should be displayed, where each screen is displayed for a period of time which corresponds to its importance; and byte TE1 being a new timing byte used when performing messages relating to auxiliary meters in accordance with the invention, and its function is described during the description of those messages.

A special keyboard acquisition program which runs automatically every 20 milliseconds serves to read the state of the keyboard keys and to store the state in the temporary keyboard image ITC. If this state does not change for a period of at least 50 milliseconds, the temporary keyboard image is transferred into the keyboard image IC.

A special date and time acquisition program runs automatically every 100 milliseconds and serves to read the contents of six counters Which constitute the calendar clock (year, month, day, hour, minute, and second) and to transfer the counter contents into the calendar clock image IHC.

A special audible alarm control program runs automatically every 20 milliseconds and reads the information contained in the three audible alarm control image bytes CAS and transfers them to the audible alarm 8 of the machine. These bytes are loaded by each program relating to a message, with audible alarms being constituted by audible beeps. Each time a beep is emitted, the first byte CAS0 is decremented by unity.

A special timing program runs automatically every 20 milliseconds and is used for timing purposes. It consists in decrementing timing byte TE0 by unity if the contents of this byte is not zero, and then in starting over on timing byte TE1.

The second and third bytes of the audible alarm control CAS and the timing bytes TE0 and TE1 are each loaded with a number. This number multiplied by the cycle time of the special timer program gives the desired length of time. For example, in order to display a screen for one second, the number 50 is loaded into timing byte TE0.

The working memory is backed up by a battery and also contains the auxiliary meters in a reserved memory space, hereinafter referred to as the "Meter" space. In above-mentioned French patent application No. 87 02667, there are 20 of these meters, and each of them is designated by a number.

The invention relates to using a large number of auxiliary meters, e.g. several tens of meters, with each meter being designated by a name rather than by a number, and with the meters being stored in the Meter space, in alphabetical order of their names which are constituted by alphanumeric characters.

Figure 4:
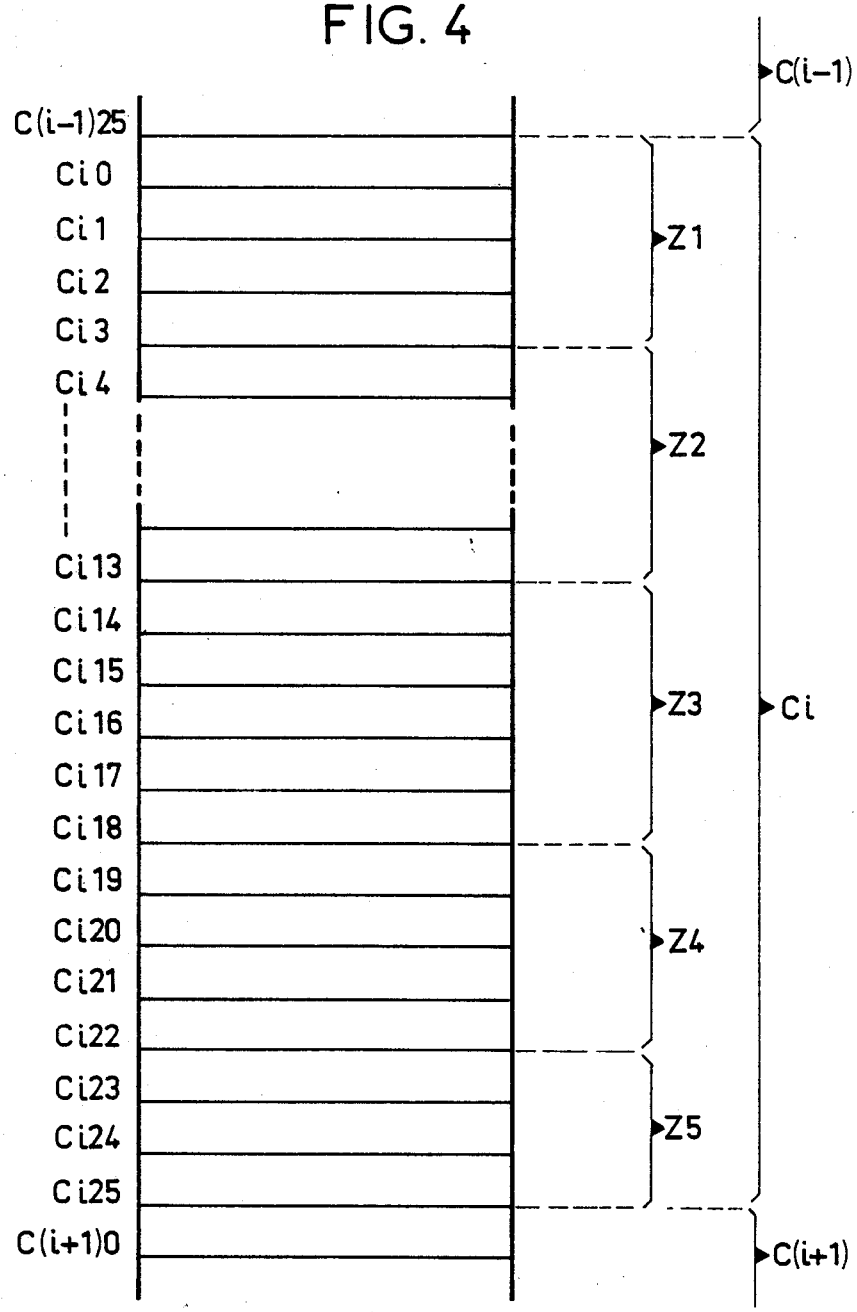
FIG. 4 shows an auxiliary meter space in a Meter space reserved in a memory for auxiliary meters in accordance with the invention.

FIG. 4 shows how one of the auxiliary meters Ci in accordance with the invention occupies its portion of the Meter space. FIG. 4 shows five different information zones:

a 4-byte service zone Z1 whose purpose is described below;

a 10-byte name zone Z2 reserved for storing the name, with each byte containing one character occupying one of columns 3, 4, and 5 of ASCII code (CCITT code No. 5), (the characters in these columns of the code have hexadecimal values lying between 30 and 5A and they include: the ten digits 0 to 9, the symbols colon (:), semi-colon (;), greater than (>), equal (=), less than (<), question mark (?), at (@), and the 26 upper case letters of the alphabet;

a 5-byte time and date zone Z3 for storing the instant at which the meter was last cleared, the information in this zone is binary coded with the five bytes containing the following, in order:

| | | |
|---|---|---|
| year | 0 to 99 | (YY) |
| month | 1 to 12 | (MM) |
| day | 1 to 31 | (DD) |
| hour | 0 to 23 | (HH) |
| minute | 0 to 59 | (Mm) |

a 4-byte franking value cumulating zone Z4, which zone serves to cumulate money values and its maximum capacity is 42,949,672.96 units of money, i.e. it operates as a 32-bit binary counter; and a 3-byte zone for cumulating the number of franking operations performed, this zone constitutes a piece counter meter and its maximum capacity is 16,777,215 pieces, i.e. it operates as a 24-bit counter.

In all, each auxiliary meter which comprises two separate meters occupies a memory space of 26 bytes in the above-described example. It would naturally be possible to have a name zone Z2 which occupied less than 10 bytes or which occupied a full 16 bytes in order to make use of the display capacity of a full line on the display which happens to be 16 characters in this case. The number of bytes in the zone Z2 is defined by the manufacturer of the franking machine and the number 10 is a value that is given merely by way of example. This value appears to be long enough to be able to identify meters by their names.

For 200 auxiliary meters, the Meter space in the working memory would need to be $26 \times 200 = 5{,}200$ bytes long. If the working memory used has a capacity of 8,192 bytes, there would remain 2,992 bytes for other information necessary for operation of the machine: temporary keyboard image, keyboard image, display image, calendar/clock image, audible alarm control, timing control, etc.

The bytes of an auxiliary Ci are referenced Ci0, Ci1, . . . , Ci25. Bytes Ci0 to Ci3 belong to the service zone Z1, bytes Ci4 to Ci13 belong to the name zone Z2, bytes Ci14 to Ci18 belong to the time and date zone Z3 recording when the meter was last cleared, bytes Ci19 to Ci22 belong to the money meter zone Z4, and bytes Ci23 to Ci25 belong to the piece count meter zone Z5.

An auxiliary meter Ci is cleared by loading 0 in the 7 bytes Ci19 to Ci25.

Each time a meter is cleared, the date and time at which clearing takes place are recorded in the 5 bytes Ci14 to Ci18. This is done by transferring the first five bytes of the calendar clock image into bytes Ci14 to Ci18 of auxiliary meter Ci. The recorded date and time are used for determining the operating duration of the auxiliary meter. The time between two clearing operations defines the periodicity of the meter, and this periodicity is defined by the user depending on requirements.

In the Meter space, the auxiliary meters are stored in alphabetical order of their names.

This Meter space is intended to contain, for example, Q=200 auxiliary meters referenced C1, C2, . . . , CQ. If only n of the meters have been made use of (n less than Q) then the first byte in the service zone Z1 of the next meter, C(n+1) contains the character ETX (03 in hexadecimal), and this character marks the end of the set of n meters in use (where ETX is an ASCII code for end of text).

There follows a description of how the user can gain access to the auxiliary meters.

As already mentioned, in order to execute programs relating to the various messages concerning the auxiliary meters as described below, it is necessary for the working memory to contain an additional timing byte TE1 whose function is described when describing the messages.

As in above-mentioned French patent application No. 82 02 667, access to the auxiliary meters is obtained via the menu key M on the keyboard. Pressing this key causes a beginning-of-menu message MP0 to appear. This is the first message of the second set of messages and it includes numbered options which are accessible from the keyboard, and in particular it includes an option:

2- Auxiliary meters

The operator selects this option by pressing the digit key 2 as mentioned in the screen, thereby giving access to the following messages which are specific to the present invention where meters are designated by their names:

| | |
|---|---|
| MP20 | Find or create meter |
| MP21 | Find meter |
| MP22 | Consult meter |
| MP23 | Confirm state selected for meter |
| MP25 | Enter meter name |

Since, in accordance with the invention, the auxiliary meters are designated by name rather than by number, pressing key 2 while message MP0 is being displayed causes message MP20 to be displayed.

Message MP20: Find or create meter

This message comprises the following three screens:

| | |
|---|---|
| Screen 1 | What do you want<br>1 - To find |
| Screen 2 | 2 - To create<br>a meter |
| Screen 3 | Make your<br>selection |

If no auxiliary meter has been set up in the Meter space, then n=0 and as a result the first byte of the Meter space contains the character ETX, so the proposal "1—To find" in the second line of Screen 1 does not appear and key 1 on the keyboard remains inactive.

If the Meter space is full, with all n=Q meters being used, it is impossible to create a new meter and the proposal "2—To create" of the first line of Screen 2 does not appear and key 2 on the keyboard is inactive.

Provided the number n of meters in use is less than the number Q of meters which can be contained in the Meter space, then pressing on key 1 will cause the "Find meter" message MP21 to appear while pressing on key 2 will cause the "Enter meter name" message MP25 to appear.

Message MP21: Find meter

This message comprises the following four screens:

| | | |
|---|---|---|
| Screen 1 | Meter number XXX XXXXXXXXXX | (3 seconds) |
| Screen 2 | What do you want 1 - To move on | (1 second) |
| Screen 3 | 2 - To move back 3 - To consult | (1 second) |
| Screen 4 | Make your selection | (1 second) |

Screens 1 to 4 are displayed for 3, 1, 1, and 1 seconds respectively.

The number of the meter appearing in Screen 1 corresponds to the position of the meter in the Meter space. Three characters are used for designating the number of the meter. The number of a meter of given name may vary as a function of meters being created or closed. Thus, if the meter THOMSON has the number 22 at some moment, and if a new meter named THOMPKINS is subsequently created, where THOMPKINS occurs before THOMSON in alphabetical order, then the meter THOMSON will have the number 23 after the meter THOMPKINS has been created.

The name of the meter appears in line 2 of Screen 1. This name occupies the ten characters of the meter name zone Z2 (assuming that meter name zones are ten characters long).

On the first occasion that message MP21 appears after message MP20, the meter proposed in Screen 1 is the first of the n meters in the Meter space, and the displayed number is therefore number 1.

Depressing the Cancel key on the keyboard while the screens of message MP21 are being displayed causes the machine to return to message MP20.

When the meter number in Screen 1 is 1, then the proposal "2—To move back" in the first line of Screen 3 does not appear and key 2 has no effect.

When the meter number is the last of the n meters, and n is less than Q, the first service byte of the next unused meter n+1 contains ASCII code ETX. As a result proposal "1—To move on" in the second line of Screen 2 does not appear and key 1 is inactive.

Briefly depressing key 1 increments the meter number by 1 in Screen 1 and causes the name of the next meter to appear. Following this action, message MP21 is reinitialized and Screen 1 is displayed for three seconds. A sequence of short key presses on key 1 following one another at intervals of less than 3 seconds cause Screen 1 to appear on a permanent basis with the various meter numbers and names changing, with one change occuring per depression of the key 1.

If the operator holds key 1 depressed for longer than one second, then accelerated movement is obtained by the program relating to message MP21 simulating short depressions of key 1 at shorter and shorter intervals. After one second, the name of the next meter appears, then the next appears after 0.9 seconds, and the next after 0.8 seconds, and so on until the names are being displayed for 0.3 seconds each. From 0.3 seconds on, the program continues to display meter names for 0.3 seconds each, but it now skips first one name, then two names, then three names, and so on. In this way, even if all Q meters in the Meter space are in use and Q=200, it is possible to scan through all Q meters in less than 11 seconds.

When the last meter has been reached or exceeded, an audible beep is emitted by the audible alarm fitted to the franking machine.

Key 2 has the same function as key 1 except that it moves backwards through the Meter space.

Pressing key 3 causes the "Consult meter" message MP22 to appear.

The text of message MP21, is stored, like that of all the other messages, in the text memory 6 of the franking machine. The text of message MP21 occupies 4×e32=128 bytes in the text memory.

The programs relating to messages MP21 to MP23 use a seven byte "search" memory space in the working memory 7, with the successive bytes therein being stored from symbolic search address zero which is that of the first byte.

These bytes, designated below as R0, R1, . . . , R6, contain:

R0=n, the number of meters in use

R1=m, the number of the meter being displayed

R2, R3=AC, the current address of the first byte of the meter being displayed

R4=MT, the acceleration timing memory

R5=INC, for incrementing the number of meters to be skipped by the acceleration function R6=PHAT, key phase.

When going from message MP20 to message MP21, an initialization program determines the number n of meters in use in the Meter space, where n is not greater than Q which is the maximum number of meters that can be contained in the Meter space. The initialization program stored this number n in byte R0, and then loads the number m=1 in byte R1 and the address AC of the first byte of the first meter in bytes R2 and R3.

Proper functioning of the program relating to message MP21 requires the presence of a subprogram SPMP21 for said program, in order to verify the way screen timing is running and to handle exit conditions (action on keys 1, 2, 3, and Cancel).

Figure 5:
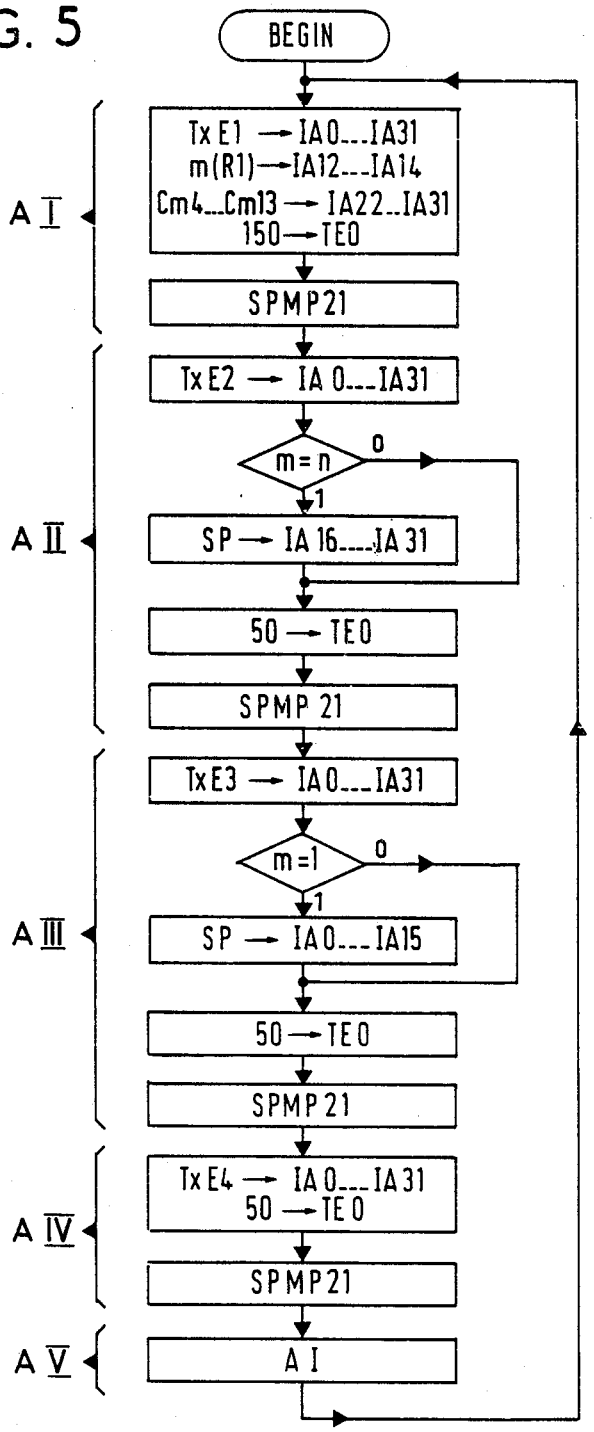
FIG. 5 is a flow chart for a program accompanying a find "meter" message MP21.

This subprogram is described after the program relating to message MP21 which contains the five following actions represented by the flow chart of FIG. 5:

Action 1:

Transfer the first 32 bytes of message MP21 (Screen 1) from the text memory to the display image IA in the working memory from address IA0 up, which is the address of the first byte of said display image. The 32 first bytes of message MP21 correspond to a 2 line by 16 character display taken by way of example.

Take m the number of the meter from R1 and store it after processing (conversion into decimal and then into ASCII code) in the display image IA at addresses IA12, IA13, and IA14 (a maximum of three digits).

Transfer the 10 bytes Cm4 to Cm13 of the name of meter m into the display image starting at address IA19. The starting address is obtained by performing AC+4 in R2 and R3, with the 10-byte transfer then running over AC+4 to AC+13.

Set the screen timing to 3 seconds (i.e. load 150 in screen timing byte TE0).

Execute subprogram SPMP21.

Action 2:

Load the text of Screen 2 into screen image IA from IA0 to IA31. If m=n, then the last meter is being displayed, in which case load 16 consecutive space symbols in the display image from IA16 up, in order to rub out the second line of Screen 2"1—To move on". If m≠n, there are more meters to be displayed and the second line of the screen should not be erased, and the 16 spaces are therefore not loaded.

Set screen timing byte TEO to 1 second (load 50 in said byte).

Call subprogram SPMP21.

Action 3:

Transfer the text of Screen 3 from the text memory into the display image IA of the working memory, from IAO to IA31. If m=1, then the first meter, is in the Meter space, is being displayed so load 16 consecutive space symbols (20 in hexadecimal) into the display image from IAO to IA15 in order to rub out the proposal "2—To move back" from the first line of Screen 3 . If m≠1, there are previous meters to be displayed and the first line of the screen should not be erased, and the 16 spaces are therefore not loaded. In either case, the program continues as described below.

Set screen timing byte TE0 to 1 second (load 50 in said byte).

Call subprogram SPMP21.

Action 4:

Load the text of screen 4 into the display image from IA0 to IA31.

Set the screen timing byte TE0 to 1 second (i.e. load 50 into said byte).

Call subprogram SPMP21.

Action 5:

Begin again with action 1 (loop).

Figure 6A:
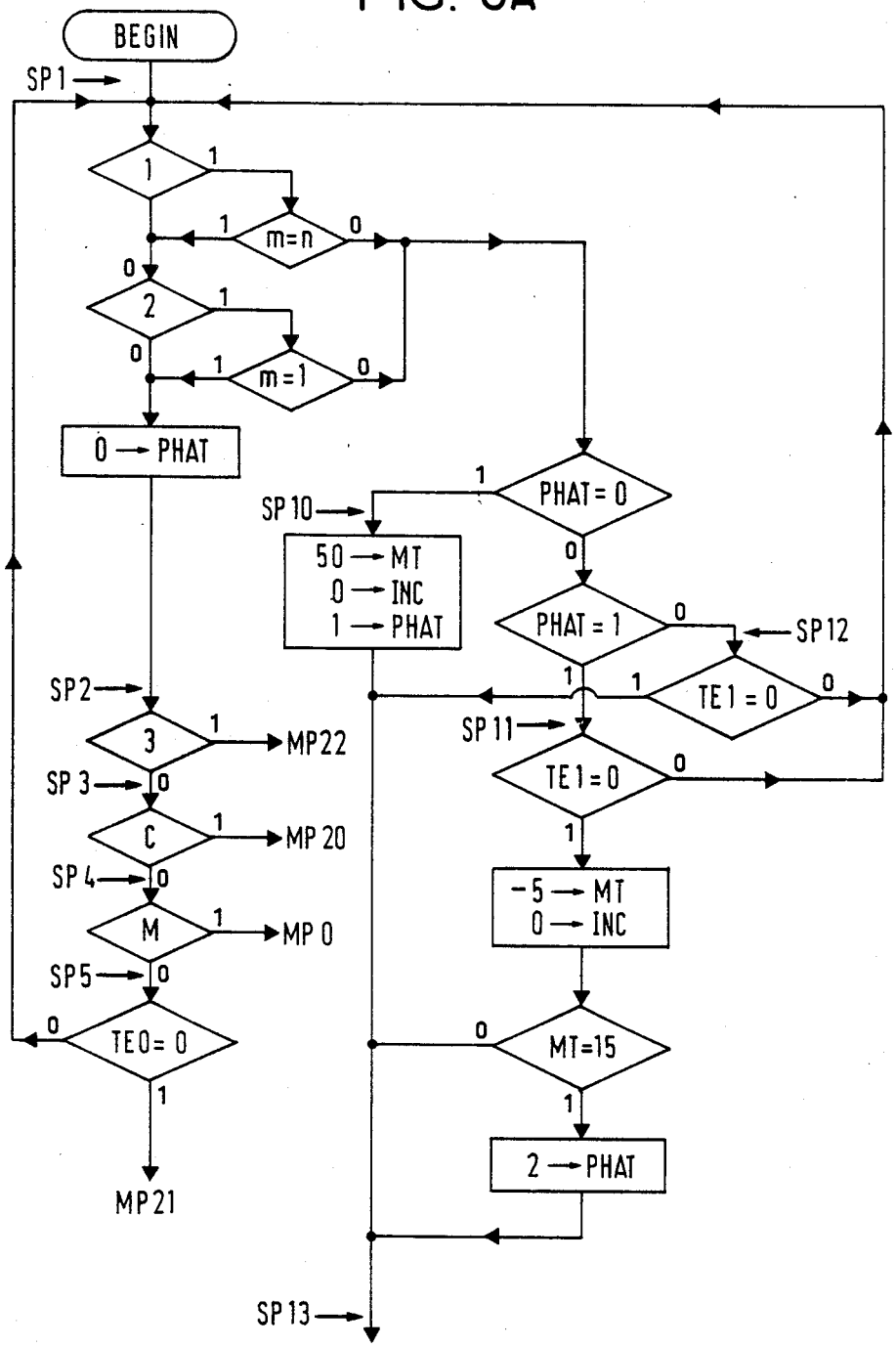
FIG. 6A and 6B together constitute a flow chart for a subprogram SPMP21 used by the program for message MP21.
Figure 6B:
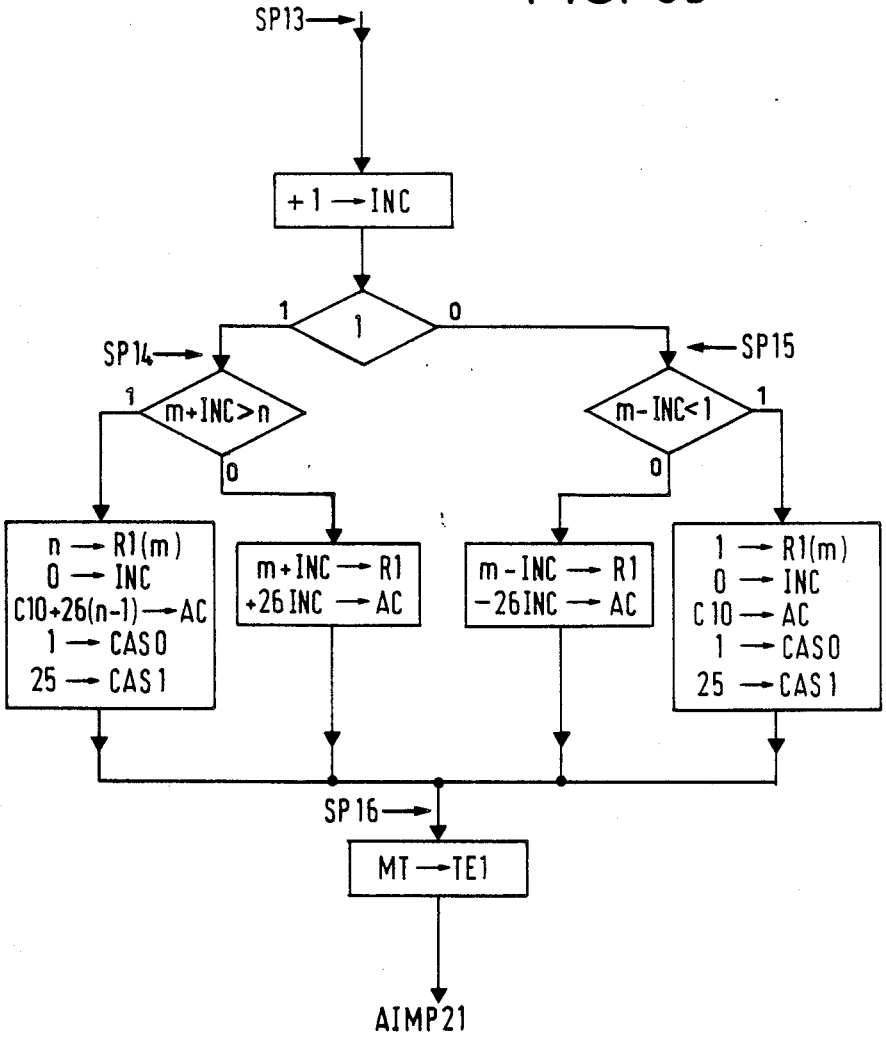

Subprogram SPMP21 shown in FIGS. 6A and 6B comprises the following actions designated SP1, SP2, . . . , etc.

Action SP1:

So long as keys 1 and 2 are not depressed, the corresponding bits in the keyboard image IC are at value 1, so put PHAT=0, i.e. load 0 into R6 and then move to action SP2.

If one or other of the keys 1 or 2 is depressed, the corresponding bit in the keyboard image takes the value 0. As long as m=n after key 1 is depressed and m=1 after key 2 is depressed, load 0 into R6 and then move to action SP2. If m is different from n for key number 1 being depressed or if m is different from 1 for key number 2 being depressed, then if PHAT=0 go to action SP10 (otherwise check to see if PHAT=1)

PHAT=1 go to action SP11

PHAT=2 (i.e, if PHAT≠1) go to action SP12.

Action SP2:

If key 3 is depressed, the corresponding bit in the keyboard image is at value 0 go to message MP22. Program MP21 has terminated.

Else go to action SP3.

Action SP3:

If the Cancel key is depressed, the corresponding bit in the keyboard image has the value 0, so go to message MP20. Program MP21 has terminated.

Else go to action SP4.

Action SP4:

If the menu key M is depressed, then go to beginning of menu message MPO. Else go to action SP5.

Action SP5:

If screen timing has elapsed, the contents of timing byte TE0 has the value 0 so return to the following action in program MP21.

Else loop back to action SP1.

Action SP10:

This action is the initialization phase for depression of keys 1 and 2 (see SP1).

Load one second (50) in R4 which is the acceleration timing memory byte (MT).

Load 0 into R5 (INC=0) which is the byte for the increment in the number of meters to be skipped as a function of the acceleration.

Load 1 into byte R6 (PHAT=1).

Go to action SP13 (display the new meter).

Action SP11:

This action decreases the time for which the meter names are displayed (see SP1).

If scroll timing has not elapsed (contents of timing byte TE1 not equal to zero), return to action SP1.

If scroll timing has elapsed (contents of byte TE1=0), reduce the scroll timing in the scroll timing memory by 0.1 seconds, i.e. subtract 5 from the contents of byte R4, and then give the value zero (INC=0) to the increment in the number of meters to be skipped, i.e. write 0 in byte R5.

If the scroll time is equal to 0.3 seconds in the scroll time memory (contents of byte R4=15), then go to phase 2, i.e. write 2 in byte R6 (PHAT=2) and then go to action SP13 (display a new meter). If MT≠15, then go directly to action SP13 without setting PHAT=2.

Go to action SP13 (display a new meter).

Action SP12:

Wait for the scroll timing to elapse (see SP1).

If the scroll timing has not elapsed (contents of timing byte TE1 not equal to zero), return to action SP1.

Else if scroll timing has elapsed (contents of timing byte TE1=0), go to action SP13.

Action SP13: Move on or back to next meter

Add plus 1 to the contents of byte R5 (INC=the number of meters to skip).

If key 1 is depressed, go to action SP14 (move on to next meter), else go to action SP15 (go back to next meter).

Action SP14:

Move on to next meter.

If m+INC is greater than n, where m is the number of the meter being displayed (contents of byte R1) and INC is the number of meters to skip (contents of byte R5), and n is the number of meters in use (contents of byte R0), then:

Read byte R0 and write its contents n in byte R1, then write 0 in byte R5 (INC=0).

Write C10+26(n−1) in bytes R2 and R3 in order to obtain the address AC of the first byte of the last meter, where C10 is the address of the first byte of the first meter in the Meter space.

Load 1 into byte CAS0 of audible alarm control CAS, to generate one audible beep.

Load 25 into byte CAS1 of audible alarm control CAS for a duration of 0.5 seconds for the audible beep (there is no need to specify the interbeep silence time since there is only one beep).

Move on to action SP16.

If m+INC is not greater than n, write m+INC in byte R1 (read the contents of bytes R1 and R5, add them together and write the result in byte R1), then perform AC+26 times INC and write the result in bytes R2 and R3 (read the contents of INC from byte R5, multiply it by 26 where 26 is the number of bytes in one meter, and then add the result to the contents of bytes R2 and R3).

Go to action SP16.

Action SP15:

Move back to previous meter.

If m−INC is less than 1 (contents of byte R1 minus the contents of byte R5 is less than 1), then:

Write 1 in R1 (m=1), i.e. return the pointer to the first meter.

Write 0 in R5 (INC=0), thereby eliminating the increment.

Write C1O in R2 and R3 (AC=C10) giving the address of the first byte of the first meter.

Write 1 in byte CAS0 of audible alarm control CAS (1 beep).

Load 25 in byte CAS1 of the audible alarm control in order to obtain a duration of 0.5 seconds.

Move on to action SP16.

If m−INC is not less than 1, then:

Write m−INC in byte R1.

Perform AC−26 times INC and write the result in bytes R2 and R3.

Move on to action SP16.

Action SP16:

Transfer the contents of byte R4 which is the byte MT of the name scrolling timing memory into timing byte TE1.

Return to action 1 of message MP21.

Message MP22: Consult meter

This message appears after pressing key 3 while message MP21 was being displayed.

Message MP22 comprises the following eight screens:

| | | |
|---|---|---|
| Screen 1 | Meter No. XXX<br>XXXXXXXXXX | (2 seconds) |
| Screen 2 | Cleared on<br>YY/MM/DD : HH.Mm | (1 second) |
| Screen 3 | Meter is XXX<br>Its totals are | (1 second) |
| Screen 4 | $ XXXXXXX.XX<br>XXXXXXXX pieces | (3 seconds) |
| Screen 5 | What do you want<br>1 - To move on | (2 seconds) |
| Screen 6 | 2 - To move back<br>3 - To clear | (2 seconds) |
| Screen 7 | 4 - To stop<br>5 - To start | (2 seconds) |
| Screen 8 | 6 - To close<br>Select | (2 seconds) |

Screens 1 to 8 are displayed for 2, 1, 3, 2, 2, 2, and 2 seconds respectively.

In Screen 1, the number of the meter in line 1 and its name in line 2 are the same as word displayed in Screen 1 of message MP21 when the operator selected option "3—To consult". The number of the meter is contained in byte R1, and its name is contained in the 10 bytes Ci4 to Ci13 of meter zone Z2, with the starting address AC+4 of Ci4 in the Meter space being given by adding for to the contents AC of R2 and R3. This is identical to the explanation of action 1 in message MP21.

The date and the time in line 2 of Screen 2 are those applicable to when the meter was last cleared, and they are contained in the five bytes of meter zone Z3 from address AC+14 up, where AC is given by the contents of R2 and R3, plus 14.

For Screen 3, the text of line 1 is filled in with "OFF" if the contents of the first byte of the meter at address AC is the letter A (for "Arreter"=Stop), or with "ON" if the contents of said first byte is the letter M (for "Marcher"=Go). The address AC is given by R2 and R3.

The two items in Screen 4 are extracted from meter zone Z4 for line 1, and from meter zone Z5 for line 2. The money total zone Z4 comprises four bytes at addresses AC+19 to AC+22 and piece count zone Z5 is constituted by three bytes at addresses AC+23 to AC+25.

If m=n, proposal "1—To move on" in Screen 5 does not appear, and it is replaced in the screen image from IA16 to IA31 by space symbols.

If m=1, proposal "2—To move back" in Screen 6 does not appear and it is replaced in the display image from IA0 to IA15 by space symbols.

If the money total in meter zone Z4 and the piece count total in meter zone Z5 are zero, then the proposal "3—To clear" in Screen 6 does not appear. It is replaced by space symbols occupying bytes IA16 to IA31 of the display image.

Proposals 4 and 5 of Screen 7 are mutually exclusive, and the only one to appear is the one which is the opposite of the current state of the meter being displayed. Thus, if the meter is ON, the first service byte in zone Z1 of the meter contains letter M, and proposal "4—To stop" appears, whereas the proposal "5—To start" does not appear, conversely, if the meter being displayed is OFF, the first service byte contains the letter A, and the proposal "4—To stop" does not appear while proposal "5—To start" does appear.

If the Cancel key is depressed, return to message MP21.

If the operator presses key 1, the program for message MP22 adds 1 to R1 giving m+1 and adds 26 to R2 and R3, giving AC+26, provided, of course, that m is less than n, otherwise there is no change.

If the operator presses key 2, and so long as m is not equal to 1, then the program subtracts 1 from R1 giving m−1, and subtracts 26 from R2 and R3 giving AC−26.

If the operator presses one of keys 3, 4, 5, or 6, then the "Confirm state selected for meter" message MP23 appears.

Message MP23: Confirm state selected for meter

This message is constituted by the following three screens:

| | | |
|---|---|---|
| Screen 1 | You have asked<br>me to XXXXX | (2 seconds) |
| Screen 2 | the meter<br>XXXXXXXXXX | (2 seconds) |
| Screen 3 | To confirm press<br>both Enter and * | (1 second) |

The text of the second line of Screen 1 is one of the following:

| | |
|---|---|
| clear | (key 3) |
| stop | (key 4) |
| start | (key 5) |
| close | (key 6) |

The text of the second line of Screen 2 is constituted by the meter name, which is the same as the name which appeared in the second line of Screen 1 of message MP22 when the operator pressed one of the keys 3, 4, 5, and 6.

The previously selected state as displayed in line 2 of Screen 1 is confirmed by simultaneously pressing both the Enter key ENTER, and the star key *, thereby returning to message MP22 with the order executed, i.e. the machine is in the newly-selected state.

Pressing the Cancel key also returns to message MP22, but the order is not executed.

If clearing is confirmed, then the seven bytes in the money total zone Z4 and the piece count zone Z5 are all set to zero (i.e. the bytes at addresses AC+19 to AC+25), and then the contents of the first 5 bytes IHC0 to IHC4 of the calendar clock image is transferred into the 5 bytes of zone Z3 at addresses AC+14 to AC+18.

If a stop request is confirmed, then the letter A (hexadecimal code 41) is loaded into the first service byte of the meter at address AC. Thereafter, this meter no longer accumulates its money total or its piece count total.

If a request to start is confirmed, then the letter M (hexadecimal code 4D) is loaded into the first service byte of the meter instead of the letter A, and the meter begins to cumulate money and pieces again.

If the operator confirms that the meter whose name is displayed in Screen 1 is to be closed, then the following program is run.

Read the byte at address AC+26 and write it at address AC, where the byte at address AC+26 is the first service byte of the next meter.

Read the byte at AC+27 and write it to address AC+1, and so on increasing the read address and the write address on each occasion until the last byte of the last meter has been transferred, i.e. until the read address has become C10+26n−1, with the address C10 being the address of the first byte of the Meter space in the working memory and the write address then being equal to C10+26(n−1)−1. In order to erase the last meter which appears twice over after it has been transferred, the character ETX is written to address C10+26(n−1) and then 1 is subtracted from R0 since after closing a meter the number of meters remaining is n−1. In the message MP22, the meter number remains unchanged and is the same as before the meter was closed, however the name of the meter is replaced with the name of the next meter in the Meter space.

Message MP25: Enter meter name

This message appears if the operator presses key 2 while message MP20 is being displayed, and providing space remains available in the Meter space.

The creation of a meter consists in entering its name, and, once the name has been confirmed, in searching for the position it should occupy in the Meter space.

For example, if the Meter space contains meters THOMPKINS and THOMSON, and a new meter THOMPSON is to be created, then the meter THOMPSON should be stored between the meters THOMPKINS and THOMSON in order to retain alphabetical order. This is done by shifting all of the meters situated after THOMPKINS through one position (which operation is identical to closing a meter, except that it is performed in the opposite direction), and then inserting the new meter THOMPSON. Naturally, it is not possible to create a new meter unless n is less than Q.

Searching for the position for the new meter whose name has just been entered, shifting the meters, and writing in the bytes for the new meter are all performed under the control of a storage program which is run after the name has been entered.

In order to perform the shift, it is necessary to search for the first meter to be shifted, once the name of the new meter is known. To do this, the storing program uses the wellknown binary search method. Once the first meter to be shifted has been found, the last byte of the last meter n in use at address C10+26n−1 in the Meter space is read and is written to address C10+26(n+1)−1 which is the last byte of meter n +1, and so on, decrementing the read address and the write address by unity until the read address is equal to the address AC of the first byte of the first meter to be shifted, at which point meter shifting is terminated. When the shifting is over, the 26 bytes of the new meter are inserted in the Meter space which has just been freed, and in the following order, said meter having the number m:

the first byte of meter m at address AC=C10+26(m−1) contains the letter A since the meter is OFF;

the next three bytes are zero;

the name of the meter is written into the next 10 bytes of zone Z2, at one character per byte, and if the name contains less than ten characters the unused bytes are loaded with the space symbol (hexadecimal code 20);

the date and the time from the calendar, i.e. the contents of bytes IHC0 to IHC4 in the calendar clock image are transferred into the 5 bytes of zone Z3 at addresses AC+14 to AC+18; and the 7 following bytes in zones Z4 and Z5 at addresses AC+19 to AC+25 are zero (i.e. the money meter and the piece count meter are set to zero).

Message MP25 comprises the following five screens:

| | | |
|---|---|---|
| Screen 1 | Meter name<br>Xsssssssss | (3 seconds) |
| Screen 2 | What do you want<br>1 - Fast up | (1 second) |
| Screen 3 | 2 - Fast down<br>3 - Confirm char | (1 second) |
| Screen 4 | 4 - Erase char<br>5 - End of name | (1 second) |
| Screen 5 | Make your<br>selection | (1 second) |

Screens 1 to 5 are displayed for 3, 1, 1, 1, and 1 second respectively.

The name of a meter may have a maximum of ten characters since it is assumed that each meter name zone Z2 contains ten bytes (one byte per character).

In Screen 1, these characters are symbolized by the letter X followed by nine spaces (letter s). Each time Screen 1 is displayed, the following symbols scroll in succession at the position of the letter X:

the ten digits 0 to 9;

the symbols : ; <=>? @ and the letters A, B, C, . . . , Z (in upper case).

The scroll rate is one character every 0.8 seconds. When the letter Z appears, the next character is the digit zero so the scrolling of admissible characters is looped, and the appearance of the digit zero causes an audible beep to be emitted in order to warn the operator that a character scroll cycle has begun.

A short press on key 1 causes the immediately following character to appear. After this action, message MP25 is reinitialized and character scrolling is suspended with Screen 1 being displayed for three seconds. A sequence of short presses on key 1 occuring at intervals of less than three seconds causes Screen 1 to appear permanently with the characters scrolling at the same position in the display and at the rate set by the operator.

If the operator now holds key 1 pressed for more than one second, the scrolling continues and accelerates progressively until it reaches a maximum rate of one character every 0.3 seconds.

Key 2 has the same effect as key 1, but causes character scrolling to take place in reverse order.

Pressing key 3 confirms the character displayed and initializes character scrolling in the position situated immediately to the right of the confirmed character. If the confirmed character is the tenth character in the name, then scrolling does not appear on the next position which is out of bounds.

Key 4 serves to return to the previous position and to erase the position which has just been left.

Key 5 allows the operator to tell the franking machine that the full name has been entered.

The procedure for storing the new meter amongst the already existing meters is then engaged, and this procedure begins, as mentioned above, by searching for the first meter to be shifted.

While displaying the message MP25, pressing the Cancel key causes a return to message MP20, and the procedure of creating a new meter is abandonned.

The program relating to message MP25 uses a 15 byte "name" zone in the working memory at symbolic address INT0 to INT14. These addresses are used as follows:

| | |
|---|---|
| INT0 to INT9: | ten bytes for the name currently being created |
| INT10: | spare byte |
| INT11: | current character position in the name being created |
| INT12: | scroll timing memory |
| INT13: | key phase |
| INT14: | automatic scrolling on or off |

The program relating to message MP25 performs various actions, some of which make use of a subprogram SPMP25 for the program for message MP25.

Figure 7:
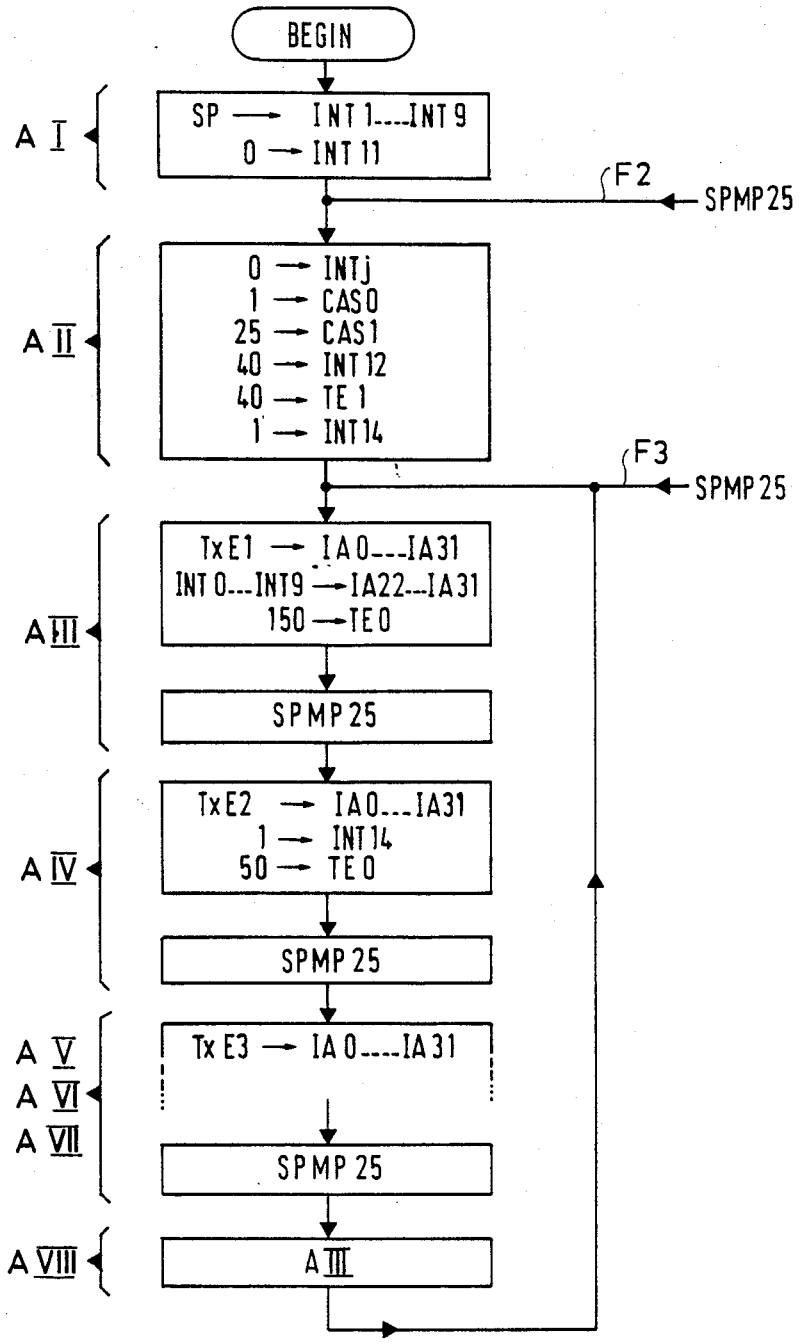
FIG. 7 is a flow chart of a program for an "enter meter name" message MP25.
Figure 8A:
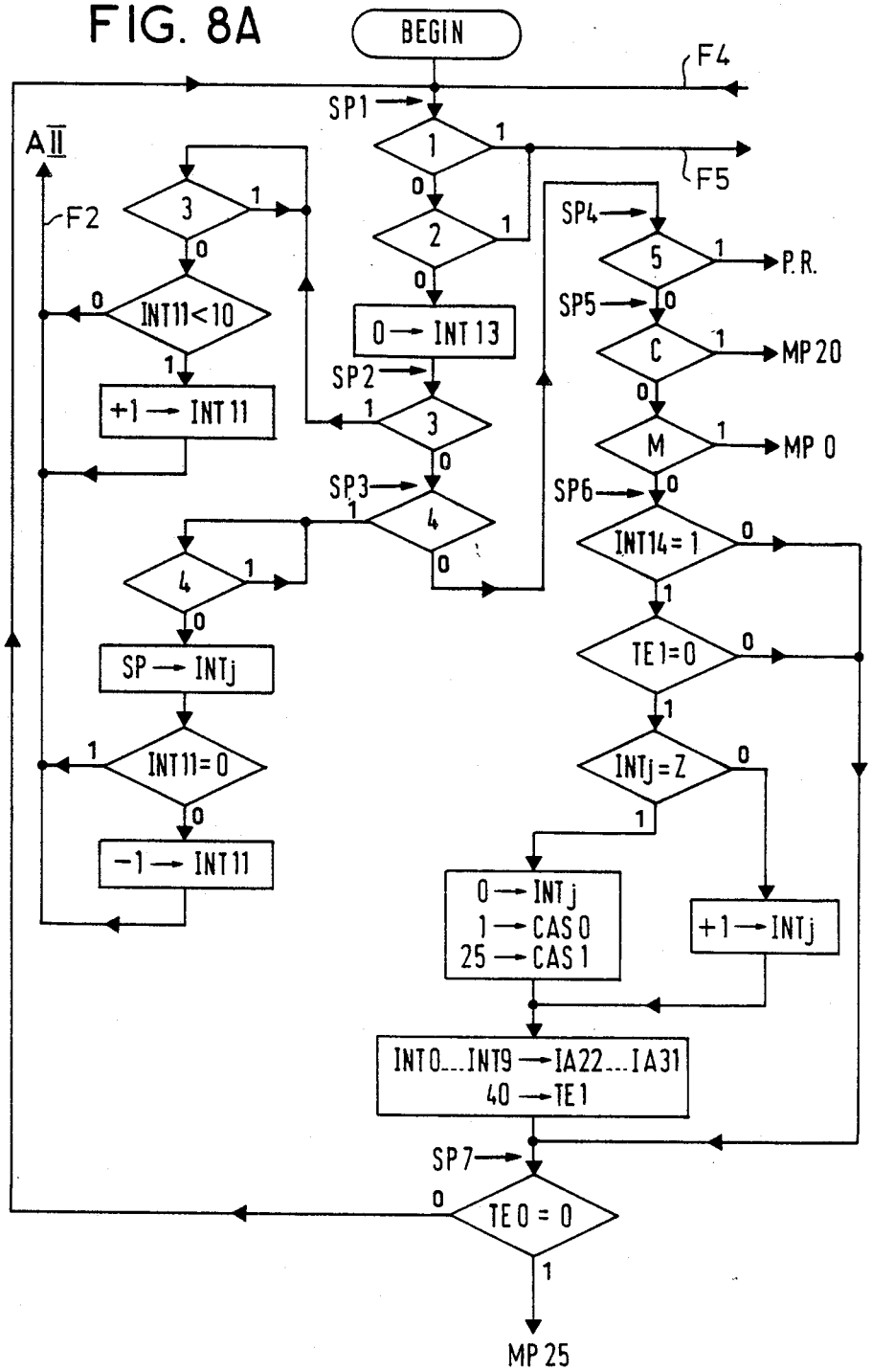
FIGS. 8A and 8B together constitute a flow chart for a subprogram SPMP25 of the program for message MP25.
Figure 8B:
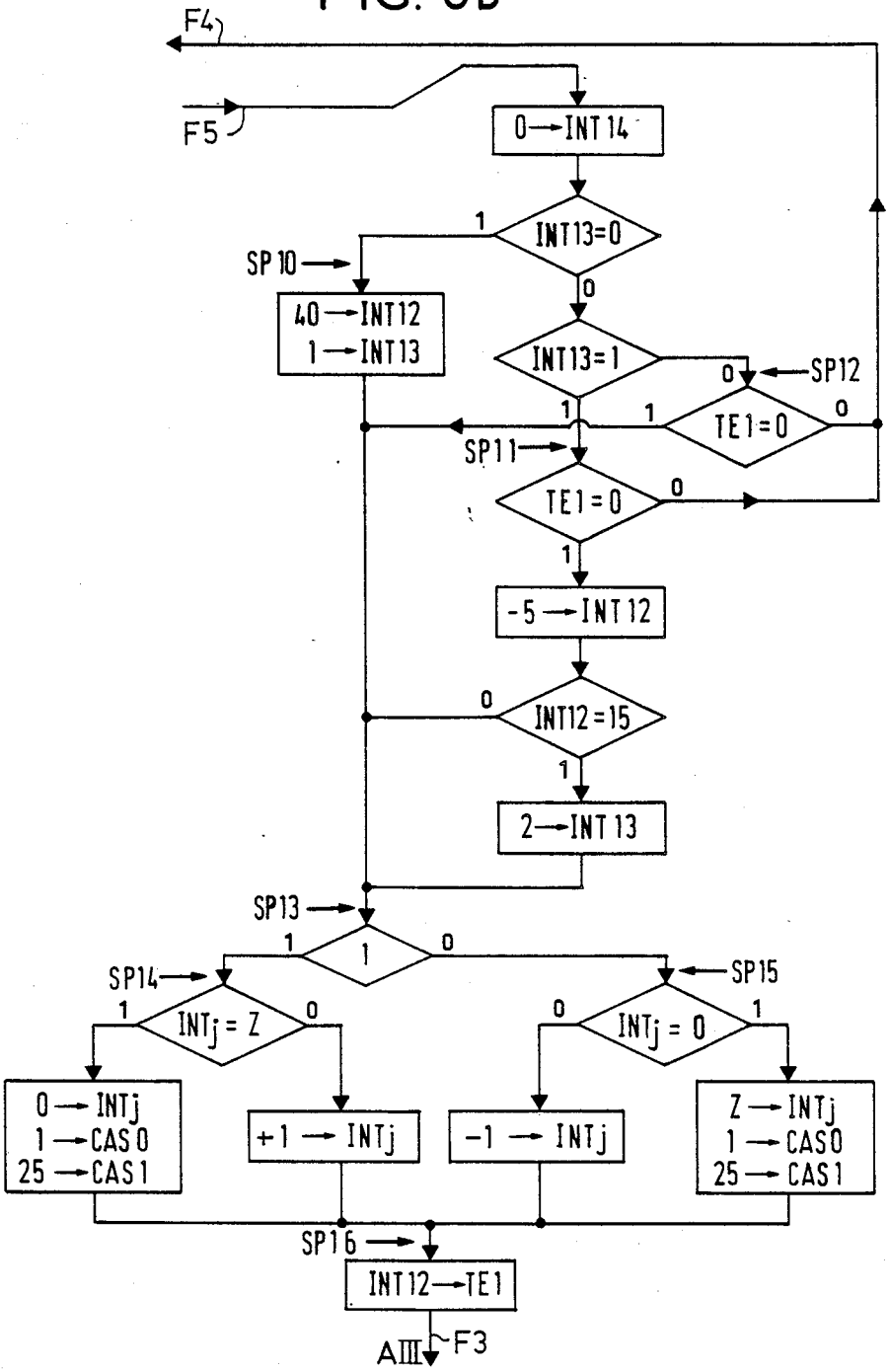

The flow chart of the program relating to message MP25 is shown in FIG. 7, and the flow chart of subprogram SPMP25 is shown in FIGS. 8A and 8B.

The program relating to message MP25 includes the following actions:

Action 1: Initialize name entry

Write the space symbol code (hexadecimal 20) to addresses INT1 to INT9.

Write zero in address INT11 to indicate the first character.

Move on to action 2.

Action 2: Initialize character scrolling

Write the digit 0 (decimal 30) in byte INTj whose address is given by the contents of INT11, and emit an audible beep (write 1 in byte CAS0 and 25 in byte CAS1 of the audible alarm control).

Initialize acceleration timing memory to 0.8 seconds by writing 40 in address INT12.

Initialize character scrolling timing by writing 40 in timing byte TE1 of the working memory.

Switch on automatic scrolling by writing 1 in address INT14.

Go to action 3.

Action 3: Display Screen 1

Transfer the 32 first bytes of message MP25 from the text memory into the display image IA (bytes IA0 to IA31).

Transfer the name being entered from address INT0 to INT9 into the display image at addresses IA22 to IA31.

Load 150 into screen timing byte TE0 in order to obtain three seconds timing.

Call subprogram SPMP25.

Action 4: Display Screen 2

Transfer the following 32 bytes of Screen 2 from the text memory into the screen image IA.

Allow automatic scrolling by writing 1 in address INT14.

Load 50 into screen timing byte TE0 in order to obtain one second timing.

Call subprogram SPMP25.

Action 5: Display Screen 3

The same as action 4, but using the 32 bytes of Screen 3.

Action 6: Display Screen 4

The same as action 4, but using the 32 bytes of Screen 4.

Action 7: Display Screen 5

The same as action 4, but using the 32 bytes of Screen 5.

Action 8: Loop

Go back to action 3.

Subprogram SPMP25 is used for verifying that screen timing is running, as defined by byte TE0, and for responding to pressing the keys 1, 2, 3, 4, 5, and Cancel. It comprises the following actions designated SP1, SP2, . . . ,:

Action SP1: Accelerate scrolling

If neither key 1 nor key 2 is depressed, write 0 at address INT13 (key phase=0), then go to action SP2.

If one or other of keys 1 and 2 is depressed, the corresponding bit in the keyboard image is at value 0, so stop automatic scrolling and write 0 at address INT14, then:

If the contents of key phase byte INT13=0, go to action SP10, otherwise check to see if INT13=1;

If the contents of key phase byte INT13=1, go to action SP11; or

If the contents of key phase byte INT13=2, i.e., if INT13≠1, go to action SP12.

Action SP2: Confirm a character and begin scrolling the next character

If key 3 is pressed, the corresponding bit in keyboard image IC is at 0, wait for the operator to release the key, i.e. wait for the value of the corresponding bit in the keyboard image IC to change to 1, then:

If the contents of position byte INT11 is less than 10, add 1 to said contents and return to action 2 of the program.

Else return to action 2 without modifying the contents of position byte INT11.

If key 3 is not depressed, go to action SP3.

Action SP3: Cancel the character and return to preceding character

If key 4 is depressed, wait for the operator to release the key, i.e. wait for the value of the corresponding bit in the key image IC to change to 1,, then:

Write "space" (hexadecimal 20) in byte INTj of the title zone at the address given by the contents of position byte INT11, (INTj being one of the bytes INT0 to INT9);

If the contents of INT11 is not equal to 0, then subtract 1 from said contents and go to action 2 of the program;

Else if the contents of INT11=0, go directly to action 2.

If key 4 is not depressed, go to action SP4.

Action SP4: End of name

If key 5 is depressed, the name is completed, end the program for message MP25, and go to the program PR for storing the meter in the Meter space.

If key 5 is not depressed go to action SP5.

Action SP5: Cancel

If the Cancel key is depressed, return to message MP20, abandon the creation of a meter. End the program for message MP25.

If the Cancel key is not depressed, and if the menu key is depressed, then go to message MP0.

If the menu key is not depressed, go to action SP6.

Action SP6: While displaying Screen 1, change the character every 0.8 seconds

If automatic scrolling is not authorized (i.e. the contents of scrolling by INT14 equals 0), then go to action SP7.

If automatic scrolling is authorized (INT14=1), and if the scrolling time has elapsed, (contents of timer byte TE1 equal 0), and if the character displayed is Z (contents of byte INTj whose address is given by the contents of address byte INT11 with INTj being one of the bytes INT0 to INT9) then write 0 in the place of Z and emit an audible beep (write 1 in CAS0 and 25 in CAS1) in order to announce the beginning of a new character presentation cycle, otherwise, if the character displayed is not Z, increment the contents of INTj. After sounding the audible beep in the case of INTj=Z, or after incrementing the contents of INTj for INTj≠Z, and then:

Write the name to the screen (copy bytes INT0 to INTg to the corresponding bytes in the display image at IA22 to IA31);

Reinitialize the scrolling time by writing 40 in timing byte TE1;

Go to action SP7.

If automatic scrolling is authorized (INT14=1) and if scrolling time has not elapsed (contents of TE1 not equal to 0), go to action SP7.

Action SP7

If screen timing has elapsed (contents of TE0=0) move on to the following screen of message MP25, else return to action SP1.

Action SP10: Initialization of a key 1 or key 2 press

Load scroll timing byte INT12 with 0.8 seconds, i.e. write 40 to said byte, move on to phase 1, i.e. write 1 in key phase byte INT13, and go to action SP13.

Action SP11: Decrease the character display time

If scrolling time has not elapsed (contents of TE1 not equal to zero), then return to action SP1;

If scrolling time has elapsed (contents of TE1=0) reduce the acceleration timing by 0.1 seconds, i.e. subtract 5 from the contents of INT12, and then:

If the scroll timing memory is equal to 0.3 seconds (contents of INT12=15), move on to phase 2, i.e. write 2 in key phase INT13 and move on to action SP13, else go directly to action SP13.

Action SP12: Waiting for the scroll timing to elapse

If the scroll timing has not elapsed (contents of TE1 not equal to zero), then return to action SP1, else If scroll timing has elapsed (contents of TE1=0), then go to action SP13.

Action SP13

If key 1 is depressed, go to action SP14 (next character), else go to action SP15 (previous character).

Action SP14

If the contents of byte INTj whose address is given by the contents of position byte INT11 is equal to that of Z (hexadecimal code 5A), then load the digit 0 into byte INTj and emit an audible beep by loading byte CAS0 to 1 and byte CAS1 to 25 in the audible alarm control CAS, and move on to action SP16, else add 1 to the contents of byte INTj and then move on to action SP16.

Action SP15

If the contents of byte INTj whose address is given by the position byte INT11 is equal to the digit 0 (hexadecimal code 30) replace said digit with the letter Z (hexadecimal code 5A) and emit and audible beep by loading byte CAS0 with 1 and byte CAS1 with 25, then go to action SP16;

else reduce the contents of byte INTj by 1 and go to action SP16.

Action SP16: Display the new character

Transfer the contents of acceleration timing memory byte INT12 to timing byte TE1 and return to action 3 of the program for message MP25.

During a franking operation, several auxiliary meters may be ON simultaneously. In the limit, all of the auxiliary meters in the Meter space may be ON simultaneously. In this case, as a result of the franking operation, the value of the stamp which has just been printed must be added to each of the money meters (zone Z4 of each auxiliary meter) and the number in each piece counter meter (zone Z5 of each auxiliary meter) must be increased by unity. This operation may be relatively lengthly, and while it is taking place, it is important to prevent the next franking operation from occuring, thereby reducing the overall performance of the machine.

To remedy this drawback, the chosen procedure consists in not updating every one of the auxiliary meters which is ON on each occasion that a franking operation takes place, but in doing so at privileged instants only. The time between two privileged instants constitutes the updating period.

The method consists in accumulating the total amount of money franked in a four-byte "period money" meter in the working memory, and in incrementing a three-byte "period piece count" meter in the working memory by unity after each franking operation. On each updating occasion, an updating program examines the first byte Ci0 of each auxiliary meter. If the contents of this byte is the letter A (OFF) then the program moves on to the next auxiliary meter.

However, if the contents of this byte is M (ON) then the program adds the contents of the "period money" meter to the contents of the money meter in the auxiliary meter, and it adds the contents of the "period piece count" meter to the piece count meter in the same auxiliary meter, after which the updating program examines the next auxiliary meter. Once the last auxiliary meter which is ON has been updated, then the program clears the "period money" and "period piece count" meters.

These updating operations take place:

on each occasion that the franking machine is switched ON, in this case the totals being updated relate to franking operations that took place immediately prior to a previous switch OFF;

when the "Find or create meter" message MP20 is displayed; or when the "Consult meter" message MP22 is displayed after a request to stop a meter (message MP23) has been confirmed.

An auxiliary meter may be associated with one or more submeters (for totals and subtotals).

A meter becomes a submeter if its name is the same as that of some other auxiliary meter followed by the at symbol @, optionally followed by further text in the form of digits or letters. For example, if the operator has created a first meter called "shop" and then a second meter called "shop @1", then the second meter is a submeter to the first.

The second service byte Ci1 of each meter is used to distinguish between meters and submeters. This byte contains the letter C for a meter (no @ in its name) and the letter S for a submeter (there is an @ in the name).

The operations of a meter and its submeters are interrelated:

A submeter may be closed independently from the other submeters of the same meter, but closing a meter automatically closes all of the submeters associated therewith.

Similarly, each submeter of a meter may be cleared independently of the others, but clearing the meter automatically causes all of its submeters to be cleared as well.

Switching a meter ON or OFF automatically causes the submeters associated therewith to be switched ON or OFF.

A submeter cannot be switched ON or OFF independently from the meter with which it is associated.

This function is obtained while message MP22 is being displayed.

If the meter being displayed is a submeter, the proposals corresponding to Screen 7 of message MP22 do not appear (switching ON or OFF).

FIGS. 5, 6A, 6B, 7, 8A, and 8B are flow charts as mentioned above.

In FIGS. 6A, 6B, 8A, and 8B, the digits 1, 2, . . . , and the letters C, M, E which appear in the diamond-shaped lozenges designate the digit keys, the Cancel key (C), the menu key (M), and the Enter key (E). In these figures, and also in FIG. 5, the digit 1 at an exit from a lozenge means "yes" and the digit 0 means "no".

In the figures, reference BEGIN means the beginning of the program or the subprogram.

In FIGS. 5 and 7, references AI, AII, . . . , designate the actions of the corresponding program.

In FIGS. 6A, 6B, 8A, and 8B, references SP1, SP2, . . . , designate the actions of the subprograms corresponding to these figures.

In FIG. 8A, reference PR in action SP4 refers to the program for storing the meter in the Meter space.

I claim:

1. A franking machine comprising a keyboard fitted with ten digit keys, an Enter key, a Cancel key, a star key, a menu key, and two scrolling keys constituted by an up arrow and a down arrow, a display of the alphanumeric type, a calendar/clock, a microprocessor, a program memory, a text memory, a working memory backed up by a battery, and an audible alarm, all interconnected by a bus, said working memory containing, in a "Meter" space, a plurality of auxiliary meters each of which is constituted by bytes of the working memory and each of which includes a money meter and a piece count meter themselves constituted by such bytes, said text memory storing a first set of messages for normal franking operations and a second set of messages for special operations, said program memory containing programs relating to each message in said first and second sets of messages, said second set of messages being accessible via the menu key, pressing said menu key causing a first or beginning-of-menu message to appear which includes numbered options, with each number corresponding to a digit key on the keyboard, one of the options giving access to the auxiliary meters, wherein the auxiliary meters are referenced by name and are stored one after the other in the Meter spaoe of the working memory in alphabetical order of their names.

2. A franking machine according to claim 1, wherein the money meter and the piece count meter in each on auxiliary meter are updated when the machine is switched ON, and on each occasion that an auxiliary meter is consulted.

3. A franking machine according to claim 1, wherein each auxiliary meter comprises, initially a service zone followed by a name zone each constituted by bytes, and wherein the meter name is constituted by alphanumeric characters with each character being contained in one of the bytes of the name zone, which zone includes a number of bytes which is not greater than the number N of characters that can be displayed on one line of the display.

4. A franking machine according to claim 3 wherein in a Meter space having a capacity of Q meters and having only n meters in use therein, with n being less than Q, the first non-used meter has a first byte in its service zone containing a special character for indicating the end of the n meters in use.

5. A franking machine according to claim 1, wherein at least one of the auxiliary meters is a parent meter associated with at least one submeter, and wherein each submeter is a meter in the Meter space and has the same name as its parent meter together with a special character which is added to said name to distinguish it from the parent meter.

6. A franking machine according to claim 5, wherein whenever each parent meter changes state to ON, OFF, or clear, each submeter associated therewith changes state at the same time.

7. A franking machine according to claim 5, wherein each submeter of a parent meter is automatically closed if ever said parent meter is closed.

8. A franking machine according to claim 5, wherein a submeter may be reset to zero independently from its parent meter.

9. A franking machine according to claim 1, wherein selecting an option giving access to auxiliary meters causes a "Find or create meter" message to appear, said message including a "Find meter" option and a "Create meter" option, with each option being numbered and being accessible by pressing a digit key on the keyboard.

10. A franking machine according to claim 9, wherein the option for finding a meter is deleted from the "Find or create meter" message when there are no meters in the Meter space, and wherein the option for creating a meter is deleted therefrom when there is no room left in the Meter space.

11. A franking machine according to claim 9, wherein selecting the "Find meter" option causes a "Find meter" message to appear, which message delivers simultaneously to the display for a display time specified by the message both the number and the name of the first meter in the Meter space, with a short press on a first key of the keyboard as specified in said message incrementing the number of the displayed meter by unity and causing the name of the next meter to appear, with a short press on a second key specified by said message decrementing the displayed meter number by unity and causing the name of the previous meter to appear, and with a short press on a third key specified by said message causing a "Consult meter" message to appear together with the number and the name of the meter being displayed when said third key was depressed.

12. A franking machine according to claim 11, wherein when scrolling in forward alphabetical order, the appearance of the name of the last meter used in the meter space causes the scanning to stop and causes an audible beep to be emitted by the audible alarm, and when scanning in reverse alphabetical order, the appearance of the first meter in the Meter space causes scrolling to stop and an audible beep to be emitted.

13. A franking machine according to claim 5, wherein the "Consult meter" message includes a digit option for closing a meter, wherein while the number and the name of a meter are being displayed, pressing the key corresponding to the number of the close meter option causes a "Confirm state selected for meter" message to appear, and wherein confirming said "Confirm state selected for meter" message causes all of the meters that follow the closed meter to be shifted successively through one meter position, beginning with the meter immediately following the closed meter, in order to occupy the space previously occupied by said closed meter.

14. A franking machine according to claim 11, wherein pressing said first key for a prolonged time accelerates the scrolling of the numbers and the names of the meters in alphabetical order, and wherein a prolonged depression of said second key accelerates the scrolling of the numbers and the names of the meters in reverse alphabetical order.

15. A franking machine according to claim 14, wherein accelerated scrolling is initially obtained by reducing the time for which the number and the name of each counter is displayed when scrolling from one counter to the next, and is subsequently obtained by displaying the number and the name for a constant length of time while skipping an increasing number of meters between two displays.

16. A franking machine according to claim 9, wherein selecting the option for creating a meter causes an "Enter meter name" message to appear, and after the name has been entered and confirmed, the position said meter is to occupy in the alphabetical order of the existing meters is searched for by comparing said name with the names of the existing meters, and when said position has been found, all the auxiliary meters beyond said position are shifted by one meter position and the new meter is inserted in the space freed thereby.

17. A franking machine according to claim 16, wherein in order to enter a name, characters from a list of characters admissible in a meter name are caused to scroll successively and automatically at a regular rate through a position of the display, with a displayed character being entered by acting on a first key specified by said message, ad wherein the entered character then appears stationary in the display, with character scrolling being initialized in the position immediately to the right of the most recently entered character.

18. A franking machine according to claim 17, wherein while displaying a character in any of the positions of the display other than the leftmost position, acting on a fourth key specified by said "Enter meter name" message stops character scrolling, erases the currently displayed character, and the character immediately to the left thereof, and initializes character scrolling in said left position.

19. A franking machine according to claim 17, wherein the appearance of the last character in the list of characters in the character up scrolling direction is followed by the first character in said list, and wherein the appearance of the first character in said list when scrolling in the down direction is followed by the last character in the list, with an audible beep being emitted by the audible alarm whenever the first character in the list appears.

20. A franking machine according to claim 17, wherein a brief depression on a second keyboard key specified by the "Enter meter name" message causes the next character to appear and a brief action on a third key specified by said message causes the preceding character to appear.

21. A franking machine according to claim 20, wherein prolonged action on said second key causes the characters to accelerate in an up direction and prolonged action on said third key causes the characters to accelerate in a down direction opposite to the up direction, said second and third keys causing character scrolling to take place more and more rapidly from the regular rate up to a maximum rate.

* * * * *